US008100035B1

(12) United States Patent
Smith

(10) Patent No.: US 8,100,035 B1
(45) Date of Patent: Jan. 24, 2012

(54) TOOL WITH SLIDEABLE WEIGHT

(76) Inventor: Clay Reece Smith, Clermont, GA (US)

( * ) Notice: Subject to any disclaimer, the term of this patent is extended or adjusted under 35 U.S.C. 154(b) by 237 days.

(21) Appl. No.: 12/506,556

(22) Filed: Jul. 21, 2009

Related U.S. Application Data

(60) Provisional application No. 61/083,329, filed on Jul. 24, 2008.

(51) Int. Cl.
*B25D 1/00* (2006.01)

(52) U.S. Cl. ..... 81/20; 81/463; 7/143

(58) Field of Classification Search ..... 81/20, 27, 81/463; 7/143, 144, 145
See application file for complete search history.

(56) References Cited

U.S. PATENT DOCUMENTS

| | | | | |
|---|---|---|---|---|
| 103,330 | A | 5/1870 | Heusser | |
| 821,155 | A * | 5/1906 | Carlton et al. | 81/20 |
| 840,580 | A | 1/1907 | McMillan | |
| 850,024 | A * | 4/1907 | Lewis | 81/25 |
| 951,890 | A | 3/1910 | Tremblay | |
| 1,089,234 | A * | 3/1914 | Leslie | 81/20 |
| 1,822,280 | A * | 9/1931 | Ervay | 254/26 R |
| 1,903,548 | A | 4/1933 | Kreis | |
| 4,399,978 | A * | 8/1983 | Moore | 254/26 R |
| 4,466,188 | A | 8/1984 | Svendsgaard | |
| 4,512,381 | A | 4/1985 | Alvarez | |
| 5,280,738 | A * | 1/1994 | Liou | 81/20 |
| 5,428,853 | A | 7/1995 | Menke et al. | |
| 5,871,204 | A | 2/1999 | Spirer | |
| 6,125,719 | A | 10/2000 | Lowther et al. | |
| 6,397,420 | B1 | 6/2002 | Roxton | |
| 7,191,685 | B2 | 3/2007 | Lowther | |
| 7,278,626 | B1 | 10/2007 | Chang | |
| 7,438,279 | B2 | 10/2008 | Eby et al. | |
| 7,520,199 | B2 | 4/2009 | Stawarski | |
| 2007/0283503 | A1 | 12/2007 | Ryan | |
| 2009/0094757 | A1 | 4/2009 | Newton et al. | |

* cited by examiner

*Primary Examiner* — David B Thomas
(74) *Attorney, Agent, or Firm* — Baker Donelson et al.

(57) ABSTRACT

A tool (10) includes an elongated shaft (11) having a handle (12) mounted at one end, a working implement (14) mounted to an opposite end, and a sliding weight (16) journalled upon the shaft for movement between the handle and working implement. The working implement includes a handle (41) which is mounted to the end of the shaft and a head (42). The handle has a longitudinal axis LA. The handle head mounting end (44) having two spaced apart flanges (45). Each flange has a central pivot hole (46) and a pull pin hole (47). The head has a central mounting portion (49) and an impact head (51) with an impact surface (52). The central mounting portion includes a central pivot hole (53), which is alignable with the handle flange central pivot hole, and an arcuate series of set pin holes (54), which are alignable with the handle flange set pin holes. A pivot pin (56) extends through the handle flange central pivot holes and head central portion pivot hole. A removable set pin (57) removably extends through the handle flange set pin holes and any one of the set of head set pin holes, depending upon the desired positioning of the head. The head is moveable between a lateral position and a longitudinal position.

10 Claims, 4 Drawing Sheets

TOOL WITH SLIDEABLE WEIGHT

REFERENCE TO RELATED APPLICATION

Applicant claims the benefit of U.S. Provisional Patent Application Ser. No. 61/083,329 filed Jul. 24, 2008.

TECHNICAL FIELD

This invention relates to tools, and specifically to hammers and other impact tools.

BACKGROUND OF THE INVENTION

Hand tools such as hammers and prybars have existed for many years. Some such tools have incorporated an elongated shaft with a sliding weight to assist the tool in producing the desired working force. For example, U.S. Pat. No. 4,466,188 shows a roofing remover having a weighted sliding sleeve which contacts an abutment collar to impart a driving force upon the head. These tools however have not been designed to both drive nails and later pry them with the assistance of an ancillary weight.

Accordingly, it is seen that a need remains for a tool that enables one to easily drive and remove nails or other objects with the use of a sliding weight. It is to the provision of such therefore that the present invention is primarily directed.

SUMMARY OF THE INVENTION

In a preferred form of the invention a tool comprises an elongated handle having a longitudinal axis, and a hammer head having an impact head with an impact surface. The hammer head is moveable between a first position wherein the impact head is aligned generally perpendicular to the elongated handle longitudinal axis and the impact surface aligned generally parallel with the elongated handle longitudinal axis and a second position wherein the impact head is aligned generally parallel to the elongated handle longitudinal axis and the impact surface aligned generally perpendicular to the elongated handle longitudinal axis. With this construction, with the hammer head impact head in its first position the tool may be used by swinging the tool in the fashion of a hammer, and with the hammer head impact head in its second position the tool may be used by moving or impacting the tool longitudinally along the handle longitudinal axis.

DETAILED DESCRIPTION

Figure 1:
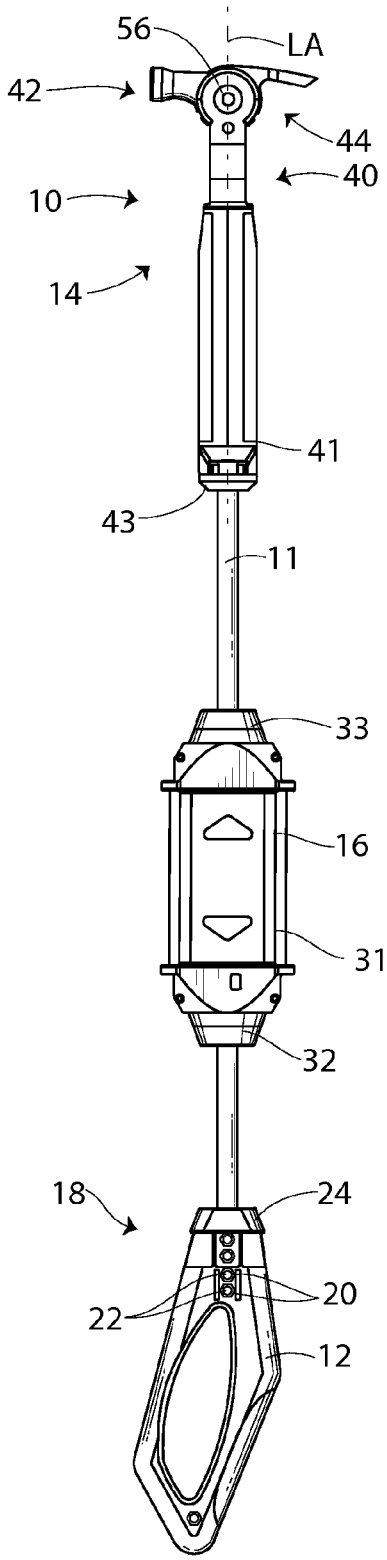
FIG. 1 is a side view of a tool embodying principles of the invention in a preferred form.
Figure 2:
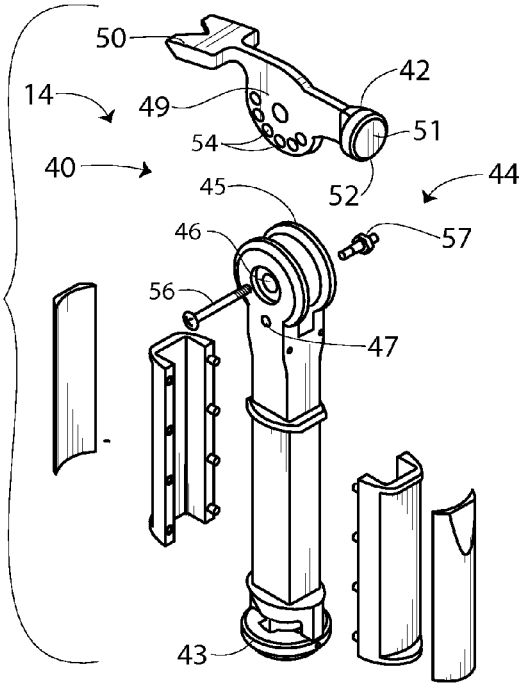
FIG. 2 is an exploded view of a working implement of the tool of FIG. 1.
Figure 3:
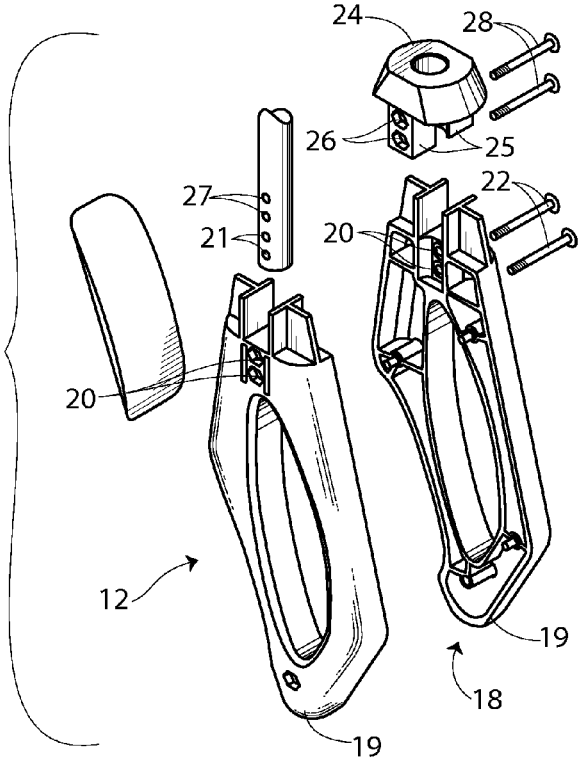
FIG. 3 is an exploded view of a handle of the tool of FIG. 1.
Figure 4:
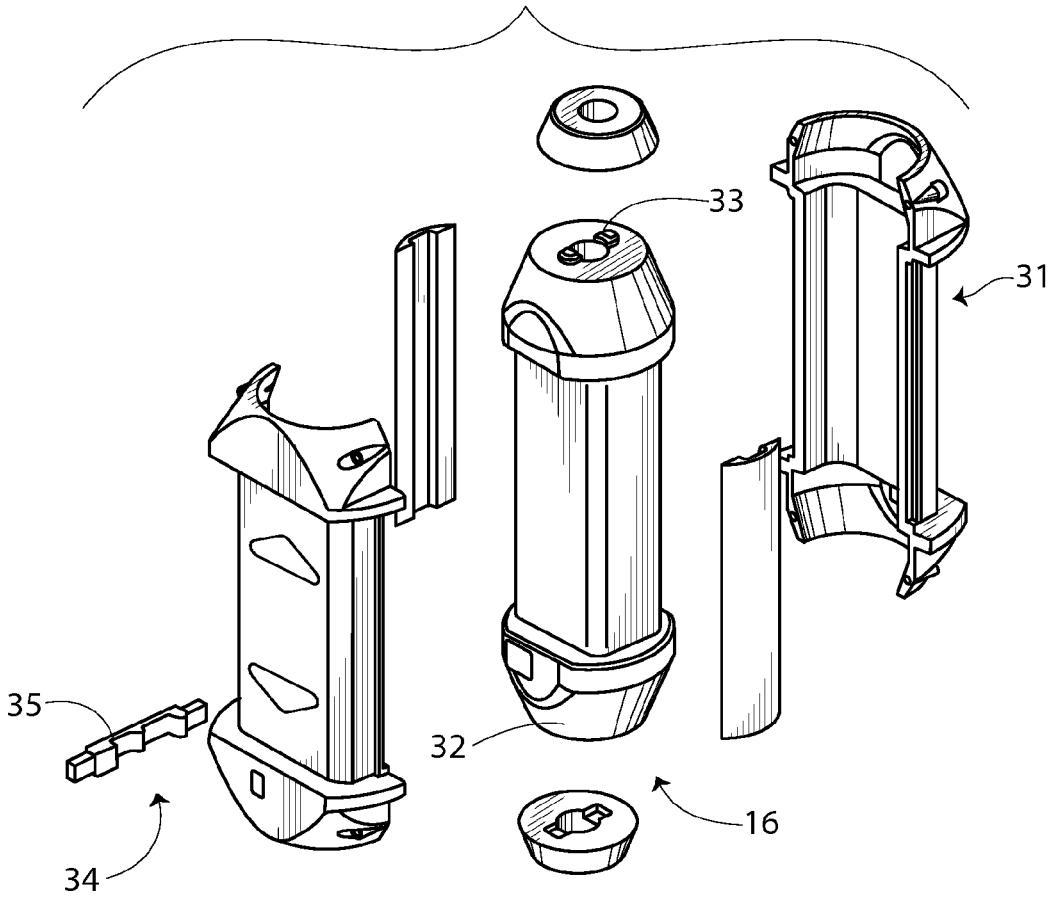
FIG. 4 is an exploded view of a sliding weight of the tool of FIG. 1.
Figure 5:
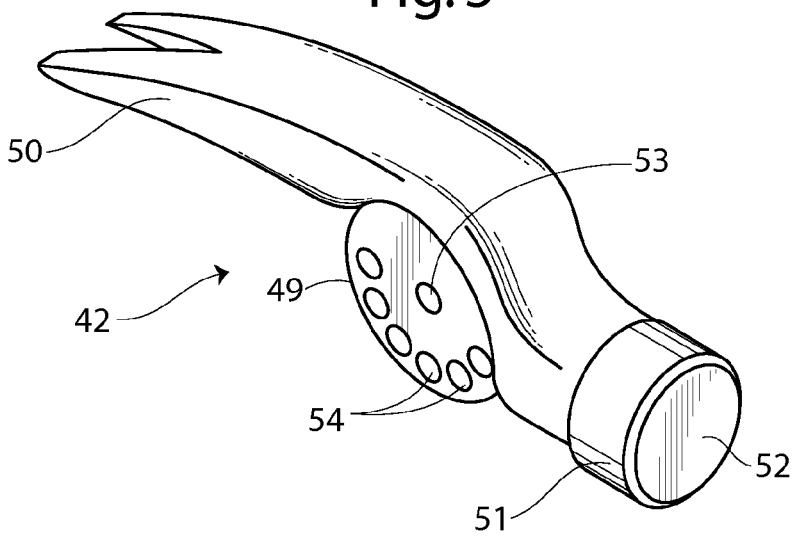
FIG. 5 is a perspective view of a hammer head of the tool of FIG. 1.

With reference next to the drawings, there is shown a tool 10 embodying principles of the invention in a preferred form. The tool 10 includes an elongated shaft 11 having a handle 12 mounted at one end, a working implement 14 mounted to an opposite end, and a sliding weight 16 journalled upon the shaft 11 for movement between the handle 12 and working implement 14.

The handle 12 includes a grip 18 comprised of two halves 19 configured to be mounted together with the end of the shaft 11 sandwiched between them. Each half 19 has a set of two mounting holes 20 which are aligned with two mounting holes 21 extending through the shaft 11 adjacent the end. A mounting bolt 22 extends through each of the grip mounting holes 20 and shaft mounting hole 21 to fix the grip 18 to the shaft 11. The handle 12 also includes a metal handle bumper or stop 24. The stop 24 has two flanges 25 each having two mounting holes 26 therein which are alignable with two additional mounting holes 27 within the shaft 11. Again, a mounting bolt 28 extends through each stop mounting hole 26 and shaft mounting hole 27 to fix the stop 24 to the shaft 11.

Figure 8:
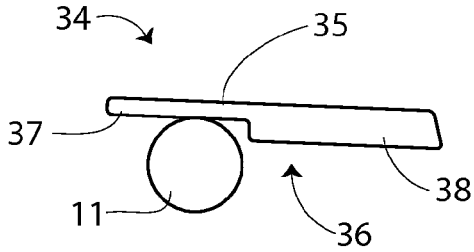
FIG. 8 is a plan view of the braking system of the tool of FIG. 1.

The sliding weight 16 includes a hand gripping portion 31, a handle abutment 32, and a working implement abutment 33. The weight 16 also includes a braking system 34 which enables the weight 16 to be locked in place. As best shown in FIG. 8, the braking system 34 includes a slideable locking bar 35 having a bottom surface 36 with a raised surface 37 and a lower surface 38. The handle abutment 32 and implement abutment 33 may be of a two piece construction with the contacting surface made of a plastic material layer to soften the noise produced when the weight collides with the stops 24 and 43 identified hereinafter.

The working implement 14 is shown in the form of a hammer 40. The hammer 40 includes a handle or handle portion 41 which is mounted to the end of the shaft 11 and a head or head portion 42. The handle 41 has a longitudinal axis LA. The handle 41 has a weight stop 43 and a head mounting end 44 having two spaced apart flanges 45. Each flange 45 has a central pivot hole 46 and a pull or set pin hole 47. The head 42 has a central mounting portion 49, a prying claw 50, and an impact head 51 with an impact surface 52. The central mounting portion 49 includes a central pivot hole 53, which is alignable with the handle flange central pivot hole 46, and an arcuate series of set pin holes 54, which are alignable with the handle flange set pin holes 47. A pivot pin 56 extends through the handle flange central pivot holes 46 and head central portion pivot hole 53. A removable set or pull pin removably extends through the handle flange set pin holes 47 and any one of the set of head set pin holes 54, depending upon the desired positioning of the head.

The working implement 14 may be designed to be removably mounted or coupled to the shaft so that different implements may be utilized. As such, the working implement handle may include a central, longitudinal mounting hole 59 extending inwardly from the end of the handle 41. The mounting hole 59 may include two oppositely disposed channels 60, which allow the passage of two protrusions 61 extending from the shaft 11 adjacent the end, and a pair of locking notches 62 offset from the channels 60. The protrusions 61 can nest within the notches 62 to lock the handle 41 to the shaft 11 by rotating the handle relative to the shaft and having the protrusions positioned within the notches 62. The protrusions 61 are maintained within the notches through the assistance of an internal spring 63 positioned within the handle and pushing against the shaft.

In use, the head portion 42 is rotatable between a first position and a second position. In the first position (a conventional hammer head position), the impact head is oriented generally normal, perpendicular or laterally to the shaft 11 and handle 41 so that the impact surface is generally parallel to the shaft 11 and handle 41, as shown in FIG. 1. In the second position, the impact head 51 is oriented generally parallel or longitudinally with the shaft 11 and handle 41 so that the impact surface 52 is generally normal or perpendicular to the shaft 11 and handle 41, as shown in FIG. 6.

With the head 42 in its first position (conventional position with the impact surface oriented generally parallel to the shaft), the tool may be used in conventional fashion to drive nails or impact upon an object by moving the tool laterally. The pry claw 50 may also be used in a conventional fashion, however, the weight 16 may be quickly slid upon the shaft 11 and impacted upon the handle stop 43 to exert an additional pulling force on the object being pried upon with the claw.

Figure 6:
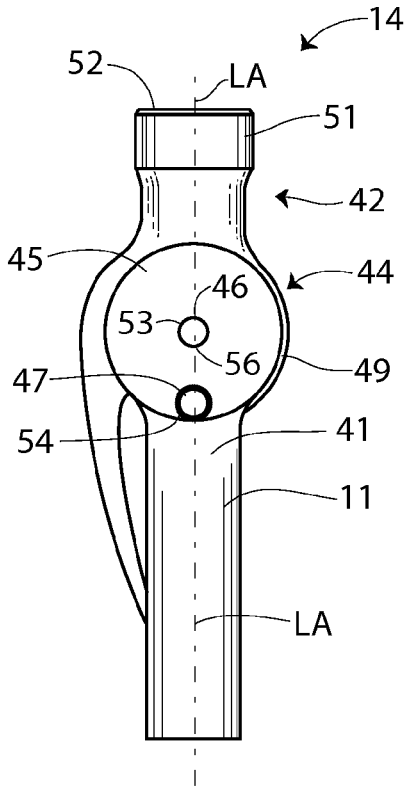
FIG. 6 is a plan view of a hammer head show aligned with the handle of the tool of FIG. 1.
Figure 7:
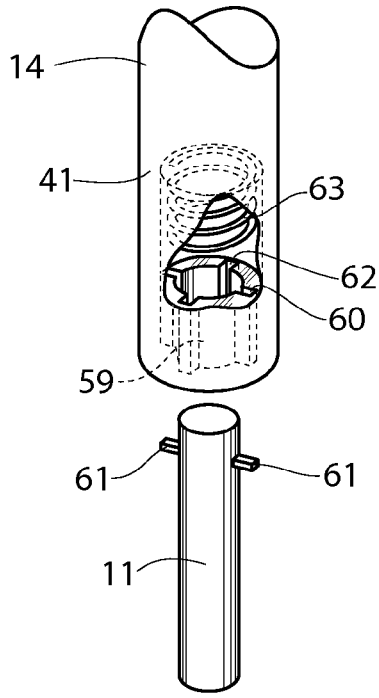
FIG. 7 is a perspective view of a portion of the shaft and working implement handle of the tool of FIG. 1.

The head 42 may also be moved to its second position, shown in FIG. 6, by removing the set pin 57 from the head set pin hole 54 and rotating the head about pivot pin 56. The head may also be moved to a number of positions between the first and second positions correlating to the number of set pin holes in the head. With the head 42 in the second position, the impact surface 52 may be place against an object (impact surface oriented generally perpendicular to the shaft and the direction of the impact force created by the contact of the sliding weight), such as a nail. The weight is then quickly moved in a direction towards the head 42 so that the weight impacts upon the weight stop 43 to exert a driving force upon the object through the impact surface 52. As such, the tool is utilized by moving or forcing it longitudinally, i.e., by creating a longitudinal driving force.

The braking system 34 may be employed to lock the position of the sliding weight 16 relative to the shaft 11. This locking prevents the weight 16 from sliding back and forth along the shaft 11 during transportation or storage of the tool. With the braking system locking bar 35 moved to an unlocked position the shaft 11 is positioned below the raised surface 37 so that the locking bar 35 does not contact the shaft 11, thereby allowing free movement of the sliding weight 16. To lock the weight in place, the locking bar 35 is moved to a locked position with the shaft 11 positioned below the lowered surface 38 so that the locking bar 35 frictionally contacts the shaft 11, thereby restricting or preventing relative movement of the sliding weight 16 along the shaft 11.

It should be understood that the terms parallel, perpendicular, normal, lateral, longitudinal and the like are not intended to represent exact degrees of relativity between objects and are intended to represent the general orientation due to variations in handle shapes, exact orientations of relative components, and the like.

It should be understood that the working implement may be of any variety, such as hatchets, prybars and prying tools, other types of hammers, and the like.

It should also be understood that the handle 41 may be configured with only one flange 45, however, it is believed that two flanges 45 are preferred to provide better strength between the handle and head. Also, the set holes 47 and 54 may be reversed so that the handle flanges include a series of set holes and the head flange includes one or more set holes.

It thus is seen that a tool having a pivotal head is now provided which overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention.

The invention claimed is:

1. A tool comprising, an elongated handle having a longitudinal axis, a hammer head having an impact head with an impact surface, said hammer head being moveable between a first position wherein said impact head is aligned generally perpendicular to said elongated handle longitudinal axis and said impact surface aligned generally parallel with said elongated handle longitudinal axis and a second position wherein said impact head is aligned generally parallel to said elongated handle longitudinal axis and said impact surface aligned generally perpendicular to said elongated handle longitudinal axis, and an elongated shaft and a weight slideably mounted upon said shaft and impactable upon said elongated handle to provide a driving force, whereby with the hammer head impact head in its first position the tool may be used by swinging the tool in the fashion of a hammer, and with the hammer head impact head in its second position the tool may be used by moving or impacting the tool longitudinally along the handle longitudinal axis.

2. The tool of claim 1 wherein said handle includes at least one flange having a pivot hole and at least one set hole, wherein said hammer head includes a flange having a pivot hole alignable with said handle pivot hole and at least one set hole alignable with said handle set hole, a pivot pin extending through said handle pivot hole and said hammer head pivot hole, and a set pin extending through said at least one handle set hole and said at least one hammer head set hole.

3. The tool of claim 1 wherein said weight includes a brake to releasably lock the position of said weight relative to said shaft.

4. A tool comprising, an elongated handle having a longitudinal axis, said handle having at least one flange having a pivot hole and at least one set hole, a head having a pivot hole alignable with said handle flange pivot hole and at least one set hole alignable with said handle flange set hole, a pivot pin extending through said handle flange pivot hole and said head pivot hole, and a set pin extending through said at least one handle flange set hole and said at least one head set hole, and an elongated shaft and a weight slideably mounted upon said shaft and impactable upon said elongated handle to provide a driving force, whereby the head may be moved relative to the handle and locked in place by placement of the set pin within the set pin holes of the head and handle flange.

5. The tool of claim 4 wherein said head flange includes an arcuate series of set pin holes each being alignable with said shaft flange at least one set pin hole.

6. The tool of claim 4 wherein said weight includes a brake to releasably lock the position of said weight relative to said shaft.

7. The tool of claim 4 wherein the head is rotatable between a first position oriented generally lateral to said elongated handle and a second position oriented generally longitudinal with said handle.

8. A tool comprising, an elongated handle, a head having an impact head, said impact head being moveable between a lateral position wherein said impact head is aligned generally laterally to said elongated handle and a longitudinal position wherein said impact head is aligned generally longitudinally with said elongated handle, and an elongated shaft and a weight slideably mounted upon said shaft and impactable upon said elongated handle to provide a driving force, whereby with the head impact head in its lateral position the tool may be used by swinging the tool laterally, and with the head impact head in its longitudinal position the tool may be used by moving or impacting the tool longitudinally along the handle.

9. The tool of claim 8 wherein said handle includes at least one flange having a pivot hole and at least one set hole, wherein said head includes a flange having a pivot hole alignable with said handle pivot hole and at least one set hole alignable with said handle set hole, a pivot pin extending through said handle pivot hole and said hammer head pivot hole, and a set pin extending through said at least one handle set hole and said at least one head set hole.

10. The tool of claim 8 wherein said weight includes a brake to releasably lock the position of said weight relative to said shaft.

* * * * *